US007649132B2

(12) United States Patent
Nickel

(10) Patent No.: US 7,649,132 B2
(45) Date of Patent: Jan. 19, 2010

(54) SNARE DRUM ASSEMBLIES, INCLUDING ASSEMBLIES WITH FLEXIBLE SNARE ANCHORS, AND ASSOCIATED METHODS

(76) Inventor: Greg Nickel, 1107 Elliott Ave. West, Seattle, WA (US) 96119

( * ) Notice: Subject to any disclaimer, the term of this patent is extended or adjusted under 35 U.S.C. 154(b) by 0 days.

(21) Appl. No.: 12/244,122

(22) Filed: Oct. 2, 2008

(65) Prior Publication Data

US 2009/0223346 A1 Sep. 10, 2009

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS 2,517,124 A * 8/1950 Ludwig et al. ..... 84/415
6,867,355 B2 * 3/2005 Okamoto ..... 84/415
6,958,440 B2 * 10/2005 Yu-Hwa ..... 84/415
7,202,405 B2 * 4/2007 Takegawa ..... 84/415

* cited by examiner

*Primary Examiner*—Jeffrey Donels
*Assistant Examiner*—Robert W Horn
(74) *Attorney, Agent, or Firm*—Perkins Coie LLP

(57) ABSTRACT

Snare drum assemblies, including assemblies with flexible snare anchors, and associated methods are described. A drum assembly in accordance with one embodiment includes a set of snare strands, each having a first end and a second end, a first, flexible snare anchor connected directly to the snare strands toward the first ends, and a second, flexible snare anchor connected directly to the snare strands towards the second ends. The snare anchors can be flexible between a first shape and a second shape different than the first shape when attaching the snare anchors to a drum. The first and second snare anchors can have generally flat, uniform shapes when not under tension, and can have a relatively thin profile (e.g., thickness) to provide for contact between the snare strands and a drum head in one or more orientations. In further particular embodiments, the drum head against which the snare assembly is positioned need not include snare beds.

23 Claims, 4 Drawing Sheets

SNARE DRUM ASSEMBLIES, INCLUDING ASSEMBLIES WITH FLEXIBLE SNARE ANCHORS, AND ASSOCIATED METHODS

CROSS-REFERENCE TO RELATED APPLICATIONS

The present application claims priority to U.S. application Ser. No. 11/333,891, filed on Jan. 17, 2006, which claims priority to the following U.S. Provisional Applications: 60/644,200, 60/644,201, and 60/644,202, all filed on Jan. 15, 2005. Each of these applications is incorporated herein by reference in their entireties.

TECHNICAL FIELD

The present invention is directed generally to snare drum assemblies, including assemblies with flexible snare anchors, and associated methods.

BACKGROUND

Typical snare drums include a cylindrical drum shell with two open ends, a drum head stretched across each open end, and a snare unit in contact with one of the drum heads. The snare unit includes multiple snare strands that contact the drum head and vibrate when the drum is played. The snare units typically include snare anchors connected to opposite ends of the snare strands, and straps connected between the snare anchors and a snare strainer assembly that is attached to the drum shell. When the snare strainer assembly is tightened, the snare strands contact the drum head. The snare strainer assembly typically includes a mechanism that allows the snare unit to be selectively engaged and disengaged from the drum head, depending upon whether the drum player wishes to have the effect of the snares or not.

Conventional snare drum shells typically include oppositely-facing recesses in the edge of the opening across which the snared drum head is stretched. These recesses cause the drum head to assume a complex, three-dimensional shape that includes corresponding, oppositely facing concave snare beds. The snare beds receive the snare anchors at each end of the snare strands, so as to allow the snare strands to contact the drum head, despite the presence of the anchors.

While the foregoing arrangement provides for a generally suitable snare drum sound, it can suffer from several drawbacks. For example, the recesses formed in the drum shell to create the snare beds add complexity to the manufacturing process of the drum. Furthermore, the presence of the snare beds may cause different strands of the snare unit to act in different manners, which may detract from the uniformity of the sound produced by the snare drum.

DETAILED DESCRIPTION

Figure 1:
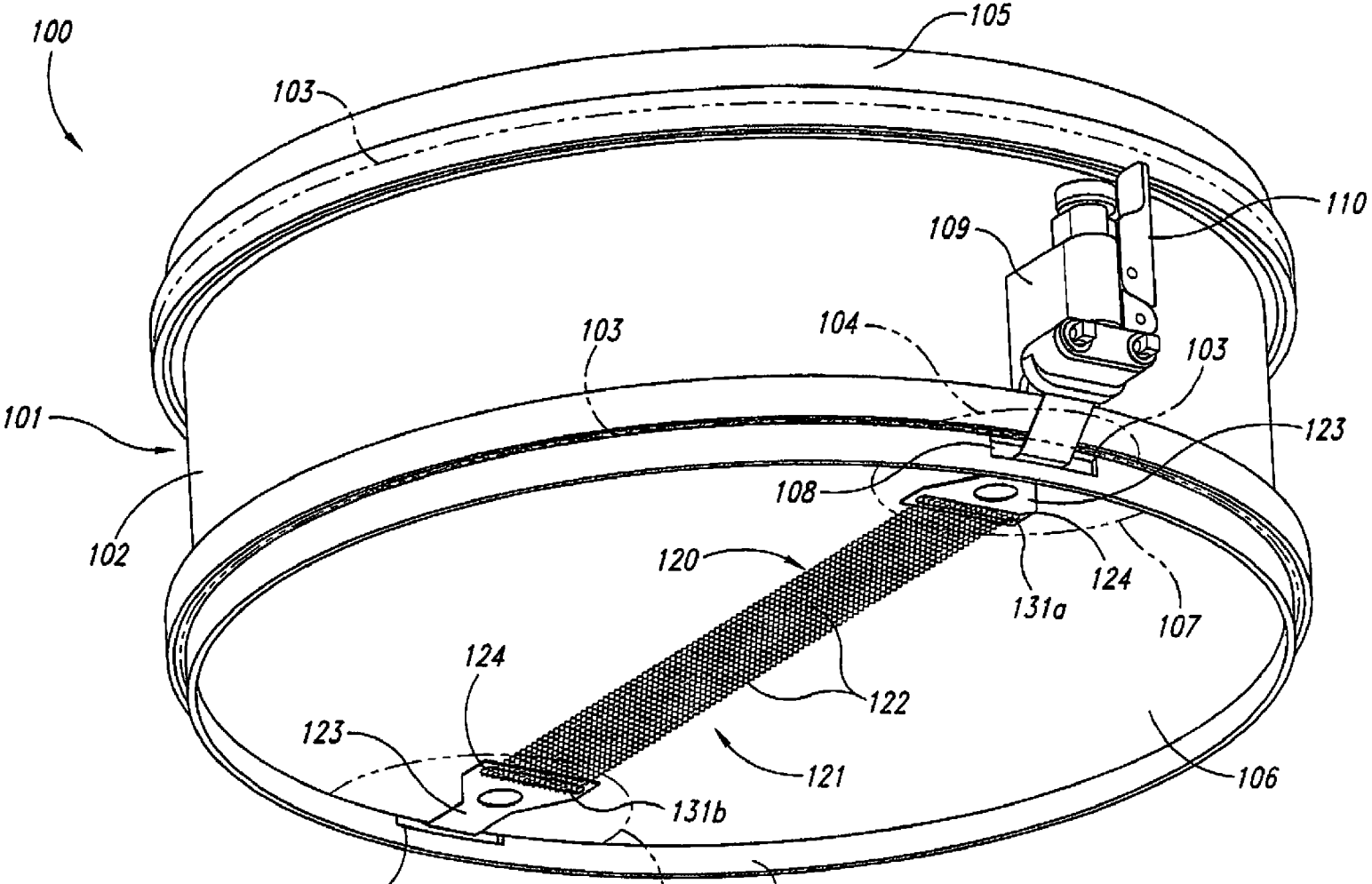
FIG. 1 is a bottom isometric illustration of a drum assembly that includes a drum and snare unit configured in accordance with an embodiment of the invention.

The present disclosure describes snare drum assemblies, including assemblies with flexible snare anchors, and associated methods for forming and using such assemblies. Many specific details of certain embodiments of the invention are set forth in the following description and in FIGS. 1-5B to provide a thorough understanding of these embodiments. One skilled in the art, however, will understand that the present invention may have additional embodiments, and that the invention may be practiced without several of the details described below.

A drum assembly in accordance with a particular embodiment can include a set of snare strands, each having a first end and a second end. The assembly can further include a first flexible snare anchor connected directly to the snare strands toward the first ends of the snare strands, and a second flexible snare anchor connected directly to the snare strands toward the second ends of the snare strands. Because the snare anchors are flexible, the drums onto which the corresponding snare unit is attached need not include snare beds. This can simplify the drums and the construction techniques used to make the drums. This arrangement can also reduce the extent to which neighboring snare strands behave in different manners. In further particular embodiments, the thickness of the snare anchors can be quite small. This arrangement can allow the snare strands to contact the drum head without requiring pre-formed offsets in the anchor, and can also allow the snare unit to be invertible so that the snare strands can contact the drum head in either a first or second (inverted) position.

Other embodiments are directed to methods for forming a drum assembly. One such method includes providing a set of snare strands, each having a first end and a second end, and attaching a first flexible snare anchor directly to the snare strands toward the first ends of the snare strands. The method can further include attaching a second flexible snare anchor directly to the snare strands toward the second ends of the snare strands.

A method in accordance with another embodiment includes attaching a first flexible snare anchor toward one side of a drum, with the first flexible snare anchor being directly attached to a set of snare strands toward the first ends of the snare strands. The method can further include attaching a second flexible snare anchor toward a second side of the drum opposite the first side of the drum, with the second flexible snare anchor being directly attached to the snare strands toward the second ends of the snare strands. The method can still further include changing a shape of each of the first and second snare anchors from the first shape to a second shape different than the first shape while tensioning the snare strands into contact with a drum head of the drum.

Still another method includes providing a set of snare strands, each having a first end and a second end, and threadably interconnecting the first end of each snare strand through holes of a corresponding row of holes in a first snare anchor. The method can further include threadably interconnecting the second end of each snare strand through holes of a corresponding row of holes in a second snare anchor. Further details of these and other embodiments are described below.

FIG. 1 is a bottom isometric illustration of a drum assembly 100 that includes a drum 101 and a snare unit 120 configured in accordance with an embodiment of the invention. The drum 101 can include a shell 102, oppositely facing drum heads 106 (one of which is visible in FIG. 1), and securement devices 109 (one of which is visible in FIG. 1) for releasably securing the snare unit 120 into contact with the drum head 106.

The drum shell 102 can include first and second edges 103, each of which defines an opening across which one of the drum heads 106 is stretched. One of the edges 103 can include two oppositely facing snare bed recesses or cutouts 104, located proximate to the securement device 109. For purposes of illustration, the dimensions of the snare bed recesses 104 are exaggerated. The drum head 106 is stretched across the opening and held in place around the edge 103 with a corresponding rim 105. As the drum head 106 is stretched across the edge 103, it forms complex, three-dimensional, concave snare beds 107 near the snare bed recesses 104. The snare beds 107 can accommodate a portion of the snare unit 120, as described below. As will also be discussed below, the snare beds 107 can be eliminated in other embodiments, and the edge 103 can have a generally circular, uniform shape, as indicated by dashed lines in FIG. 1.

The snare unit 120 can include a set 121 of snare strands 122. The snare unit 120 can further include two snare anchors or tail pieces 123, one attached to the snare strands 122 toward first ends 131*a* of the snare strands 122, and the other attached to the snare strands 122 toward second ends 131*b*. Attachment devices 124 attach the snare strands 122 to the corresponding snare anchors 123. The snare strands 122 can be formed from a metallic material (e.g., stainless steel) and can have a generally helical shape. In other embodiments, the snare strands 122 can be formed from nonmetallic materials, such as string, and/or can have other, non-helical shapes. The attachment devices 124 can be selected depending upon the characteristics of the snare strands 122 and the snare anchors 123. For example, in particular embodiments, the attachment devices 124 can include an epoxy or other glue, stitches, tape, and/or threaded connections. An embodiment in which the snare strands 122 are threadably connected to a corresponding snare anchor is described later with reference to FIG. 5A.

One or both of the snare anchors 123 can be formed from a durable, flexible material, such as stainless steel, and one or both can be generally flexible. Accordingly, the snare anchors 123 can extend through corresponding rim notches 108 to attach directly to the securement devices 109. At least one of the securement devices 109 (e.g., the one visible in FIG. 1) can include a handle 110 for selectively tightening and releasing the snare unit 120. When the drum 101 includes the snare beds 107, the flexible nature of the snare anchors 123 can allow each snare strand 122 to conform to the contours of the snare bed 107. In other embodiments, the snare anchors 123 can be flexible and thin enough to eliminate the need for a snare bed 107 entirely. Further details of the snare anchors 123 are described below with reference to FIGS. 2-4.

Figure 2:
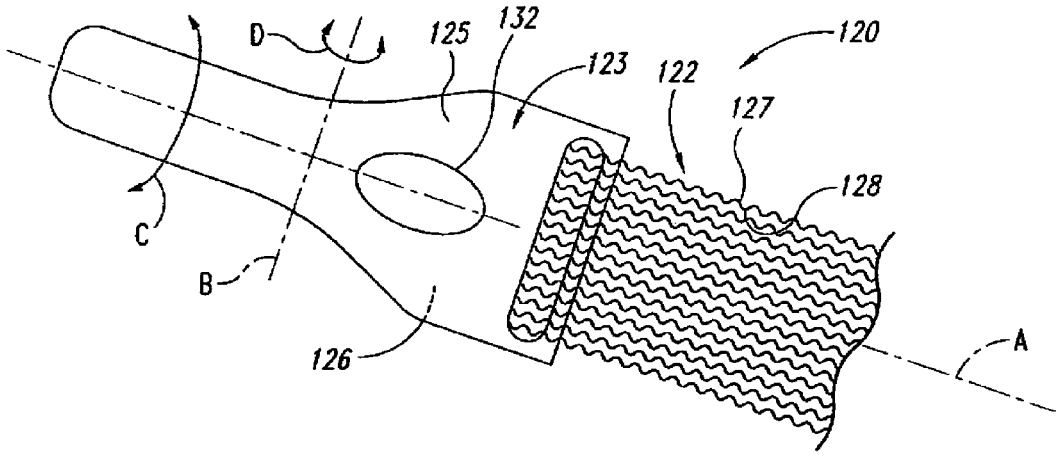
FIG. 2 is a bottom isometric illustration of a portion of the snare unit shown in FIG. 1, configured in accordance with an embodiment of the invention.

FIG. 2 is a bottom isometric illustration of a portion of the snare unit 120 shown in FIG. 1. The snare anchor 123 can have a first side 125 facing generally outwardly from the plane of FIG. 2, and a second side 126 facing opposite the first side 125. Each of the snare strands 122 can also include a first side 127 facing generally outwardly from the plane of FIG. 2, and a second side 128 facing opposite the first side 127. Each of the snare strands 122 can be attached to the snare anchor 123 with the second side 128 of the snare strand 122 attached directly to the first side 125 of the snare anchor 123. The snare anchor 123 can be flexible about multiple axes, including a longitudinal axis A (as indicated by arrow C), and a lateral axis B (as indicated by arrow D). The flexibility of the snare anchor 123 can allow the snare anchor 123 to change shape as it is attached directly to the securement device 109 (FIG. 1), and can accommodate each of the snare strands 122 conforming to the local shape of the drum head 106 (FIG. 1). In at least one embodiment, the snare anchor 123 can have one or more apertures 132 extending through the snare anchor from the first side 125 to the second side 126. The aperture 132 can increase the flexibility of the snare anchor 123 and/or reduce the likelihood for the snare anchor 123 to form ripples or other non-uniformities when placed under tension. The aperture, 132 can also provide for an aesthetically pleasing appearance.

Figure 3:
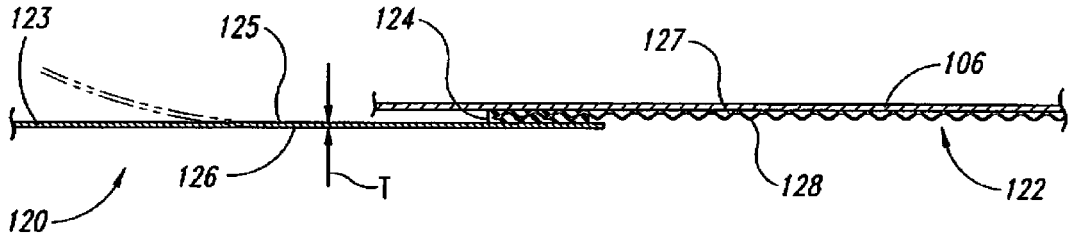
FIG. 3 is a side, cross-sectional illustration of an embodiment of the snare unit shown in FIG. 2, positioned against a drum head in accordance with an embodiment of the invention.
Figure 4:
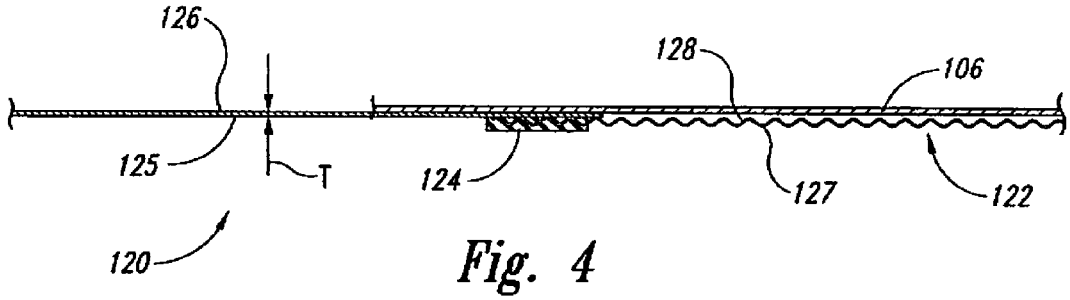
FIG. 4 is a side, cross-sectional illustration of the snare unit shown in FIG. 3, inverted and positioned against the drum head in accordance with another embodiment of the invention.

FIGS. 3 and 4 illustrate two orientations with which the snare unit 120 may be placed in contact with the drum head 106. For example, as shown in FIG. 3, the snare unit 120 may be positioned so that the first side 125 of the snare anchor 123 faces toward the drum head 106. Accordingly, the first sides 127 of each of the snare strands 122 contact the drum head 106 when the snare unit 120 is tensioned. As shown in FIG. 3, the snare anchor 123 can flex (as indicated schematically by phantom lines) so as to change shape as the snare unit 120 is tensioned. In a particular embodiment, the snare anchor 123 can have a relatively small thickness T to enhance the ability of the snare anchor 123 to flex. In a particular embodiment, the snare anchor 123 can have a thickness T of from about 0.001 inches to about 0.020 inches. In a further particular embodiment, the thickness T of the snare anchor 123 can be from about 0.001 inches to about 0.010 inches. In still a further particular embodiment, the thickness T can be about 0.002 inches. In other embodiments, the snare anchor 123 can have other thicknesses, including thicknesses greater than 0.02 inches, depending on the material selected for the snare anchor 123. The material can include a metal material or other materials, including plastics.

As shown in FIG. 4, the snare unit 120 can be inverted relative to the orientation shown in FIG. 3, while still allowing the snare strands 122 to contact the drum head 106. In the orientation shown in FIG. 4, the second side 126 of the snare anchor 123 is positioned to face toward the drum head 106. Because the thickness T of the snare anchor 123 is relatively small, the second side 128 of each of the snare strands 122 comes into contact with the drum head 106 when the snare unit 120 is tightened.

One feature of an arrangement of the snare unit 120 shown in FIGS. 3 and 4 is that the unit can be inverted while still allowing the snare strands 122 to contact the drum head 106. In particular embodiments, the force with which the snare strands 122 contact the drum head 106 may be different (e.g., less) when the snare unit 120 is placed in the orientation shown in FIG. 4 than when the snare unit 120 is placed in the orientation shown in FIG. 3, due to the thickness (albeit the small thickness) T of the snare anchor 123. An advantage of this arrangement is that it can allow the drum player to selectively obtain different sounds with the same snare unit 120 by simply inverting the snare unit 120.

Another feature of an embodiment of the snare unit 120 described above with reference to FIGS. 1-4 is that the anchor 123 can have a generally flat, uniform shape before it is placed under tension as it is attached to the drum 101. This is unlike existing snare anchors, which typically include a "dogleg" when seen in side view. The presence of the dogleg in existing snare anchors allows the snare strands to contact the drum head when the snare anchors are placed in an orientation like that shown in FIG. 3. In an aspect of an embodiment of the invention shown in FIG. 3, such a dogleg is not required because the snare anchor 123 is so thin and flexible that the snare strands 122 contact the drum head 106 in the absence of a dogleg or other pre-formed feature. This arrangement can be both more versatile and easier to manufacture than are existing snare units.

Another advantage of embodiments of the flexible snare anchors 123 is that they can contact the drum head 106 with a generally uniform contact force (a) along the length of each snare strand 122 and/or (b) from one snare strand 122 to the next. This arrangement can reduce the likelihood for "sympathetic buzz," which can result when some snare strands are only loosely in contact with the drum head while other snare strands have the appropriate amount of tension applied to them. The effect of sympathetic buzz is that such loose snare strands resonate not only when the drum is played (as they should), but also when the drum is exposed to resonant frequencies that may be emitted by other nearby musical instruments (as they should not).

Another advantage of embodiments of the flexible snare anchors 123 is that they can allow more individual activity by each snare strand 122. Such activity can be constrained or eliminated by conventional rigid couplings. For example, the flexible snare anchors 123 can isolate (at least in part) the vibrations of one snare strand 122 from other snare strands 122. As a result, the dynamic response of the snare unit can be enhanced.

Still another feature of embodiments of the snare units described above is that, when used with drums having snare beds, the flexible nature of the snare anchor can allow each strand to individually conform to the local shape of the snare bed, reducing the tendency for each strand to have a different tension applied to it. Furthermore, if the snare unit is used on a drum that does not have a snare bed, the thin profile of the snare anchor can allow the snare strands to contact the drum head despite the absence of the snare bed. In such cases, the drum head can form a generally flat, uniform surface across the opening over which it is attached. This arrangement can simplify the construction of the snare drum itself by eliminating the need for the snare bed recesses 104 (FIG. 1) in the edge of the drum shell 102 (FIG. 1). Accordingly, the time and/or cost associated with manufacturing the drum can be reduced, and/or the uniformity with which multiple drum units are manufactured can be increased.

In some embodiments, a strap or series of parallel strings (not shown) can be used to attach each snare anchor 123 to the corresponding securement device 109. In other embodiments, the snare anchors 123 can attach directly to the securement devices 109 without the need for a separate strap or set of strings. Accordingly, the snare anchors 123 can have a unitary construction between the snare strands 122 and the securement device 109. An advantage of an embodiment that includes the unitary snare anchor 123 is that it can be simpler to manufacture.

Figure 5A:
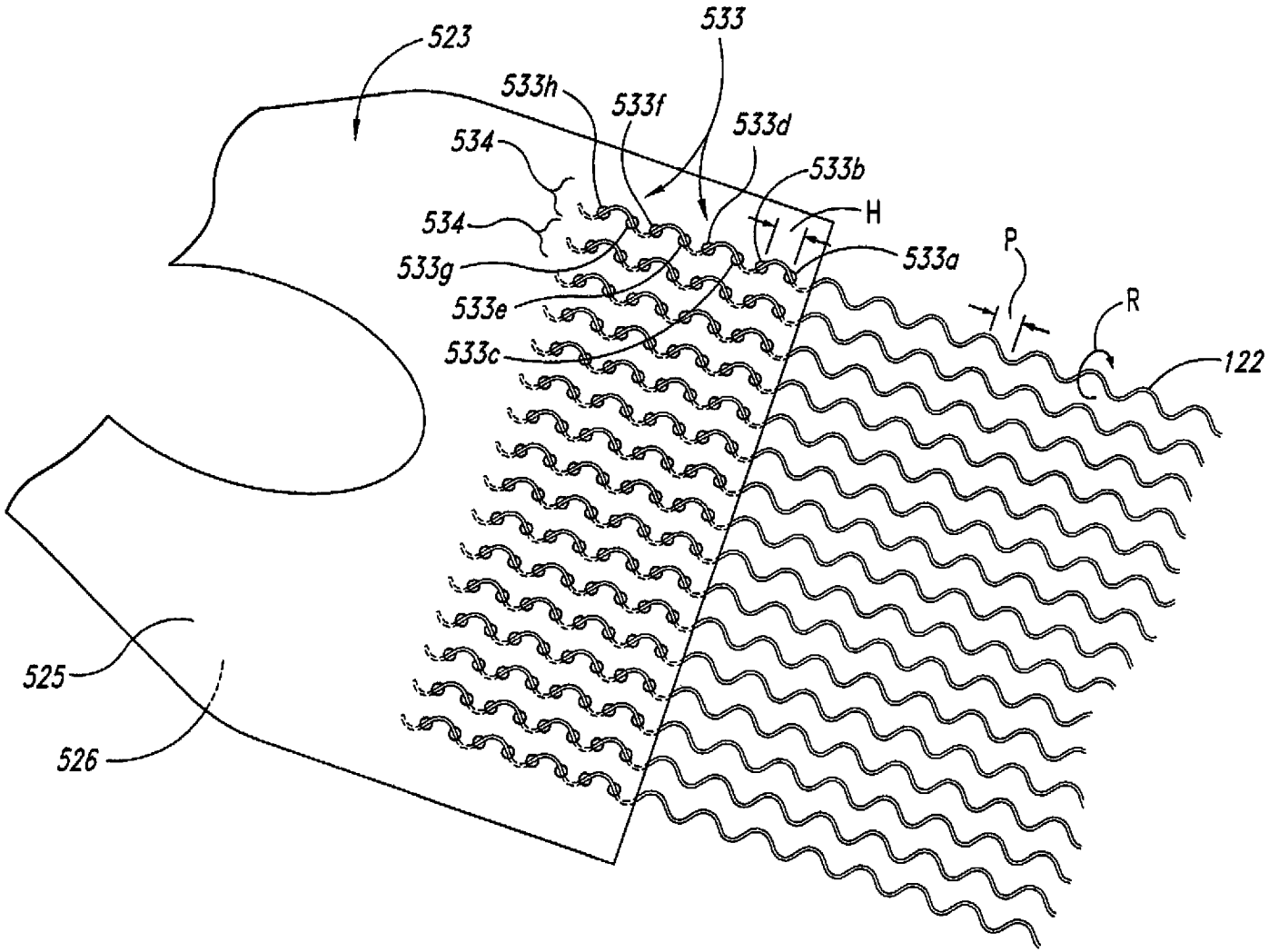
FIGS. 5A and 5B are top isometric illustrations of snare units having snare strands attached to an anchor in accordance with still further embodiments of the invention.

As described above with reference to FIG. 2, the snare strands 122 can be attached to the snare anchor 123 in accordance with several different techniques. FIG. 5A illustrates snare strands 122 connected to a snare anchor 523 in accordance with one such technique. The snare anchor 523 can include several rows 534 of alternately offset holes 533, one row for each snare strand 122. The holes 533 of each row 534 can be spaced apart by a distance H that is approximately the same as the pitch P between successive revolutions of the helical snare strands 122. Accordingly, the end of each snare strand 122 can be placed into an end hole 533*a* of a corresponding row 534, and rotated (as indicated by arrow R) through a sufficient number of cycles (four, in the example shown in FIG. 5A) so as to pass through the remaining holes 533*b-h*. In other embodiments, each row 534 can include more or fewer holes 533. In any of these embodiments, the holes 533 can provide a simple, secure way of attaching the snare strands 122 to the anchor 523, and can easily allow individual snare strands 122 to be removed and replaced (e.g., when broken) without disturbing neighboring snare strands 122. Another feature of this arrangement is that the snare strands 122 can project away from corresponding first and second sides 525, 526 of the snare anchor 523 by approximately equal amounts. Accordingly, the snare strands 122 will tend to contact the drum head 106 (FIG. 1) with about the same amount of force, independent of whether the first side 525 or the second side 526 is mounted to face toward the drum head 106.

Figure 5B:
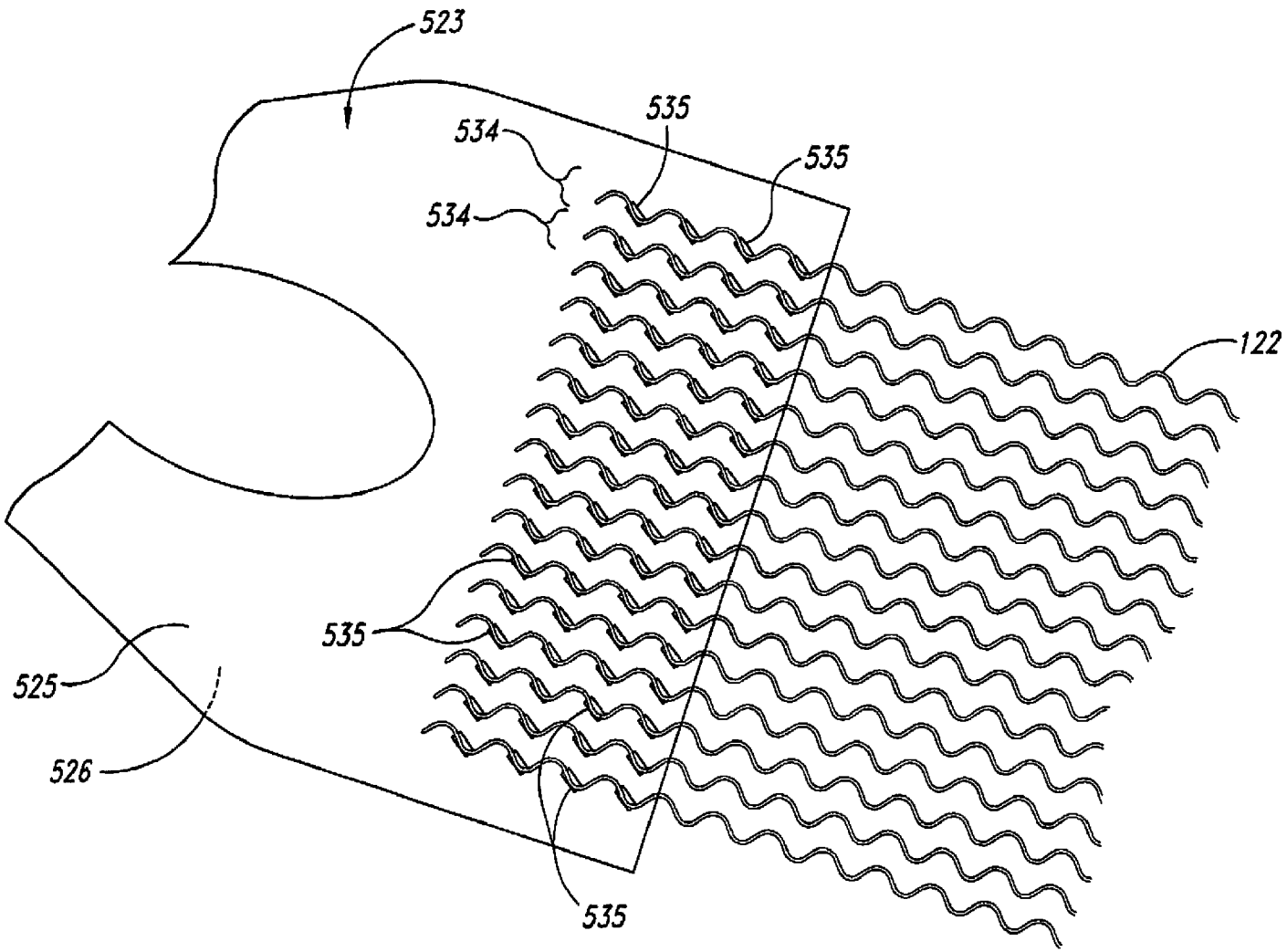

FIG. 5B illustrates the snare strands 122 attached to the snare anchor 523 in accordance with another embodiment. In one aspect of this embodiment the snare strands 122 can project away from the corresponding first and second sides 525, 526 of the snare anchor 523 by approximately equal amounts (as discussed above with reference to FIG. 5A), via an attachment arrangement that differs from that described above with reference to FIG. 5A. Accordingly, the snare anchor 523 can include rows 534 of slots 535, with each slot 535 positioned to receive a corresponding downwardly-projecting portion of the snare strands 122. Once the snare strands 122 have been recessed into the corresponding slots 535, they can be fixed in place with tape, glue (e.g., epoxy) and/or another attachment device applied to one or both of the sides 525, 526.

From the foregoing, it will be appreciated that specific embodiments of the invention have been described herein for purposes of illustration, but that various modifications may be made without deviating from the spirit and scope of the invention. For example, the snare units may have shapes, dimensions, and/or arrangements different than those shown in FIGS. 1-5. The drums on which such snares are mounted may include features in addition to and/or other than those shown in the Figures. Drums with such features are described in U.S. Pat. Nos. 6,093,877 and 5,557,053, as well as U.S. application Ser. No. 11/333,872, titled "A Resonating Chamber for an Acoustic Instrument", all incorporated herein by reference. Although advantages associated with certain embodiments of the invention have been described in the context of those embodiments, other embodiments may also exhibit such advantages. Additionally, none of the foregoing embodiments need necessarily exhibit such advantages to fall within the scope of the invention. Accordingly, the invention is not limited except as by the appended claims.

I claim:

1. A drum assembly, comprising:

a drum shell having an opening bounded by an edge of the shell;

a drum head stretched across the opening;

a first securement device depending from the drum shell;

a second securement device depending from the drum shell;

a plurality of snare strands, each having a first end and a second end, the snare strands being positioned to face toward the drum head;

a first snare anchor connected between the first securement device and the snare strands toward the first ends of the snare strands; and a second snare anchor connected between the second securement device and the snare strands toward the second ends of the snare strands, the first and second anchors each having a flexible portion facing the drum head, the flexible portion having a generally flat planar shape when detached from the drum shell, and being flexible about multiple axes to allow neighboring snare strands to assume different shapes, orientations, or both shapes and orientations when attached to the drum shell.

2. The drum assembly of claim 1 wherein the snare strands include a first side positioned to contact a drum head, and a second side facing opposite from the first side, and wherein the first and second snare anchors are attached to the second side of each snare strand.

3. The drum assembly of claim 1 wherein the first and second snare anchors each include stainless steel.

4. The drum assembly of claim 1 wherein the snare strands are attached to the snare anchors with at least one of the following: glue, stitches, tape, and threaded connections.

5. The drum assembly of claim 1 wherein at least one of the snare anchors includes a row of holes for an individual snare strand and wherein the snare strands are helical, further wherein an individual snare strand is threaded through the holes of a corresponding one of the rows of holes.

6. The drum assembly of claim 1 wherein the snare strands include a first side and a second side facing opposite from the first side, and wherein the first and second snare anchors are attached to the second side of each snare strand, and wherein the snare strands contact the drum head when under tension, independent of whether the first or second sides of the snare strands face toward the drum head.

7. The drum assembly of claim 1 wherein the first snare anchor is connected directly to the first securement device, and wherein the second snare anchor is connected directly to the second securement device.

8. The drum assembly of claim 1 wherein all the strands positioned adjacent to the drum head are connected the first securement device via the flexible portion of the first snare anchor, and wherein all the strands positioned adjacent to the drum head are connected the second securement device via the flexible portion of the second snare anchor.

9. The drum assembly of claim 1 wherein the first and second snare anchors each have a thickness of from about 0.001 to about 0.020 inches.

10. The drum assembly of claim 1 wherein the first and second snare anchors each have a thickness of about 0.002 inches.

11. The drum assembly of claim 1 wherein the snare strands include metal strands, non-metal strands, or both.

12. A drum assembly, comprising:

a plurality of snare strands, each having a first end and a second end;

a first snare anchor connected to the snare strands toward first ends of the snare strands; and a second snare anchor connected to the snare strands toward second ends of the snare strands, the first and second anchors each having a flexible portion with a generally flat planar shape when detached not under tension, and being flexible about multiple axes to allow neighboring snare strands to assume different shapes, orientations or both shapes and orientations when placed under tension.

13. The drum assembly of claim 12 wherein the first and second snare anchors each include stainless steel.

14. The drum assembly of claim 12 wherein the snare strands are attached to the snare anchors with at least one of the following: glue, stitches, tape, and threaded connections.

15. The drum assembly of claim 12 wherein at least one of the snare anchors includes a row of holes for an individual snare strand and wherein the snare strands are helical, further wherein an individual snare strand is threaded through the holes of a corresponding one of the rows of holes.

16. The drum assembly of claim 12 wherein the first and second snare anchors each have a thickness of from about 0.001 to about 0.020 inches.

17. The drum assembly of claim 12 wherein the first and second snare anchors each have a thickness of about 0.002 inches.

18. The drum assembly of claim 12 wherein the snare strands include metal strands, non-metal strands, or both.

19. A method for forming a drum assembly, comprising:

attaching a first snare anchor toward one side of a drum, the first snare anchor being attached to a set of snare strands toward first ends of the snare strands, the first snare anchor having a flexible portion facing toward a head of the drum;

attaching a second snare anchor toward another side of a drum, the second snare anchor being attached to the set of snare strands toward second ends of the snare strands, the second snare anchor having a flexible portion facing toward the head of the drum; and tensioning the snare strands into contact with the drum head while allowing first and second neighboring snare strands to assume different shapes, orientations, or both shapes and orientations as they individually conform to a local shape of the drum head, and while the snare strands are attached to the first and second snare anchors.

20. The method of claim 19, further comprising isolating, at least in part, vibrations of the first snare strand from vibrations of the second snare strand.

21. The method of claim 19 wherein the snare strands include a first side and a second side facing opposite from the first side, and wherein the first and second snare anchors are attached to the second side of each snare strand, and wherein tensioning the snare strands includes tensioning the snare strands into contact with the drum head independent of whether the first or second sides of the snare strands face toward the drum head.

22. The method of claim 19, further comprising:

threadably interconnecting the first end of an individual snare strand through holes of a corresponding row of holes in the first snare anchor; and threadably interconnecting the second end of the individual snare strand through holes of a corresponding row of holes in a second snare anchor.

23. The method of claim 19 wherein attaching the first and second snare anchors includes attaching snare anchors having a generally flat uniform shape when not under tension.

* * * * *

UNITED STATES PATENT AND TRADEMARK OFFICE

CERTIFICATE OF CORRECTION

PATENT NO. : 7,649,132 B2
APPLICATION NO. : 12/244122
DATED : January 19, 2010
INVENTOR(S) : Greg Nickel It is certified that error appears in the above-identified patent and that said Letters Patent is hereby corrected as shown below:

On the face page, in field (76), in "Inventors", in column 1, line 2, delete "96119" and insert -- 98119 --, therefor.

In column 1, line 9, delete "11/333,891," and insert -- 11/333,894, --, therefor.

In column 4, line 12, delete "aperture," and insert -- aperture --, therefor.

In column 7, line 32, in claim 8, after "connected" insert -- to --.

In column 7, line 35, in claim 8, after "connected" insert -- to --.

Signed and Sealed this

Twenty-second Day of June, 2010

David J. Kappos

David J. Kappos
*Director of the United States Patent and Trademark Office*